United States Patent [19]

Dixon

[11] Patent Number: 4,696,336

[45] Date of Patent: Sep. 29, 1987

[54] VERTICAL BLINDS CHAIN

[76] Inventor: John A. Dixon, 9576 Ledge Acres Rd., Macedonia, Ohio 44056

[21] Appl. No.: 823,188

[22] Filed: Jan. 27, 1986

[51] Int. Cl.[4] ..... E06B 9/38

[52] U.S. Cl. ..... 160/178 R; 160/166 A; 59/93

[58] Field of Search ..... 160/178 R, 178 E, 166 A; 59/2, 900, 93, 80

[56] References Cited

U.S. PATENT DOCUMENTS

| | | | |
|---|---|---|---|
| 3,500,896 | 3/1970 | Endou | 160/178 R |
| 3,916,973 | 11/1975 | Schuppler et al. | 160/178 R |
| 4,529,025 | 7/1985 | Oskam | 160/166 A |

FOREIGN PATENT DOCUMENTS

| | | | |
|---|---|---|---|
| 64729 | 11/1982 | European Pat. Off. | 160/166 A |
| 2293570 | 7/1976 | France | 160/166 A |

*Primary Examiner*—Robert L. Spruill
*Assistant Examiner*—David B. Jones
*Attorney, Agent, or Firm*—Renner, Otto, Boisselle & Lyon

[57] ABSTRACT

A chain for attachment to a vertical blind. A longitudinally extending continuous length of thread has a plurality of plastic clips fixedly secured thereto at spaced intervals. Each of the plastic clips has means for engaging a portion of a vertical blind, and each of the plastic clips has a portion completely circumscribing a portion of the thread. A plurality of plastic objects are fixedly secured to the length of thread at a plurality of locations spaced between the clips, with each of the plastic objects completely circumscribing a portion of the thread. The thread is preferably a braided polyester material, and the plastic clips and the plastic objects are preferably molded to the length of thread.

5 Claims, 5 Drawing Figures

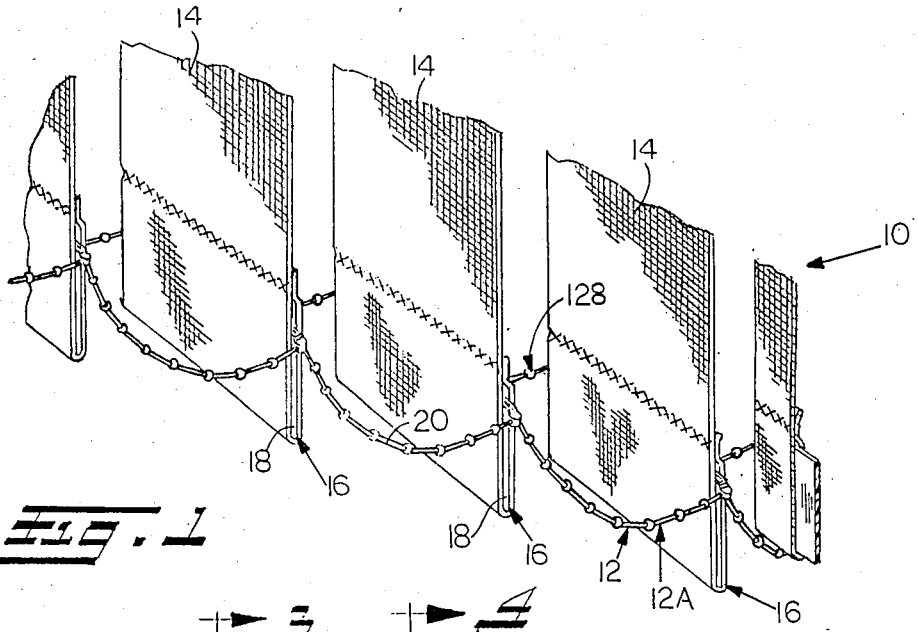
FIG. 1
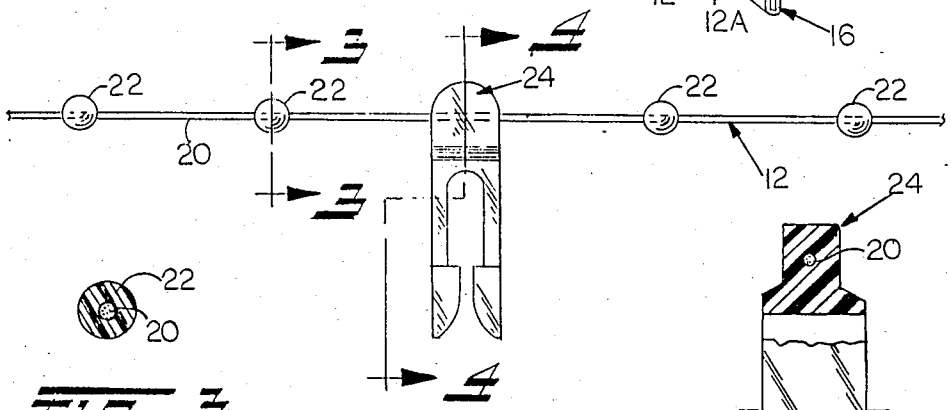
FIG. 2
FIG. 3
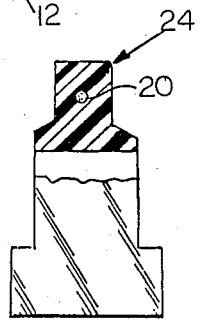
FIG. 4
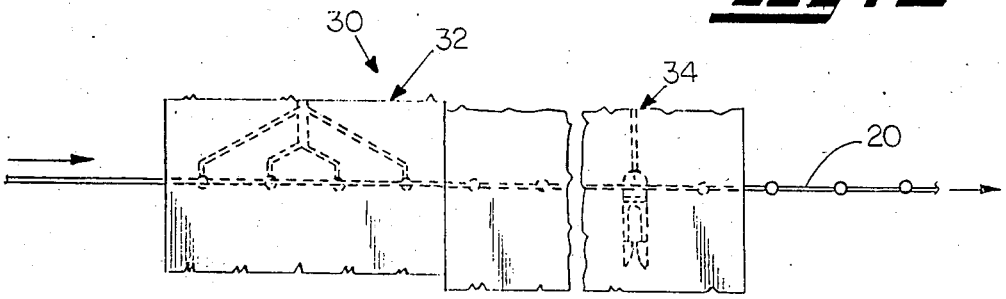
FIG. 5

VERTICAL BLINDS CHAIN

BACKGROUND

The present invention pertains to a chain for maintaining the ends of a vertical blind in a predetermined geometrical relation to each other. It relates particularly to a chain which is easily manufactured, and which provides a high degree of strength for securing together the ends of a vertical blind in predetermined geometric relation to each other.

Vertical blinds typically comprise a plurality of vertically oriented slats or louvers that hang vertically from a headrail, and which cooperate to provide an ornamental appearance to a window or other type of structure. The slats(louvers) are manipulated (e.g., rotated about vertical axes) to change their orientation relative to the window, thereby changing the ornamental appearance of the window or controlling the glare of the sun.

Typically, the bottom ends of the slats forming the vertical blind are secured together with chains. The chains help maintain the slats in a predetermined geometrical relation to each other when the blind is hanging from the headrail and also when the blind is being manipulated into a different geometrical orientation relative to a window. In addition, the slats are joined together by chains which maintain the slats in generally vertical orientation, and to help insure proper relative movement of the slats when the blind is manipulated. A conventional type of prior chain for a vertical blind comprises a metal chain comprised of metal links and small metal balls disposed at the ends of the metal links. In addition, at periodic spaced intervals there are plastic clips which can be secured to portions of the ballast weight at the lower end of each of the vertical slats. The plastic clips also have resilient portions which are designed to allow the ball portions of the chains to be snap fitted to the clips in order to secure the chain with the clip. Another known type of chain construction provides fabric (e.g., nylon) threads with plastic balls that are snap fitted into the resilient portions of the clips in order to secure the chain to the clips.

BRIEF DESCRIPTION OF THE INVENTION

The present invention provides a new and useful construction for a chain for attachment to a vertical blind. The chain construction of the present invention is designed so that both the balls and the clips are integrally molded directly to a length of strong thread, rather than the balls being snap fitted onto the clips. With that construction the balls and the clips are molded directly to the length of the strong thread in a continuous type of operation, in a way which securely couples them to the fabric during the molding process. Such construction facilitates continuous manufacture of a chain for connection to a vertical blind.

In addition, a chain according to the invention is believed to provide a secure, and possibly stronger, chain than has been heretofor achieved by the use of metal chains snap fitted into the plastic clips. Specifically, the present invention provides a polyester thread which is extremely strong and does not have separate links, any of which can break during the fabrication or the operation of the chain. Moreover, the molded plastic balls and clips provide a tight and secure way of connecting those elements to the strong nylon chain. Additionally, since the chain of the invention is formed exclusively of synthetic components, it provides better corrosion resistance than a chain made of metal components.

According to a basic aspect of the invention, the chain comprises a longitudinally extending length of thread, with a plurality of plastic clips fixedly secured to the length of fabric at spaced intervals. Each of the plastic clips has a resiliently deflectable means for engaging the ballast weight at the bottom of a vertical slat (louver), for controlling the movement of the slats (louvers) when traversed or rotated. Further, each of the plastic clips has a portion completely circumscribing the fabric and a plurality of plastic geometric objects (e.g., plastic balls) are fixedly secured to the length of thread at a plurality of locations spaced between the clips. Each of the plastic geometric objects and the plastic clips are molded directly to the length of thread and completely circumscribe the length of thread. Thus, there are no resiliently deflectable portions used for securing the length of thread to the plastic balls or to the plastic clips.

The polyester thread is preferably a braided thread to provide the maximum strength to the thread. The plastic geometric objects are preferably spherical to provide a pleasing exterior appearance as well as to provide sufficient ballast to the chain.

With a chain constructed according to the principles of the invention, the plastic objects and the plastic clips can be molded directly to the thread in a continuous operation. More specifically, a set of plastic balls and a plastic clip can be simultaneously molded to the length of thread in one molding operation, the thread advanced, and another set of balls and plastic clips molded to the thread in another molding operation. The ability to form the objects by direct molding to the polyester length of thread is useful because it allows continuous formation of the chain.

The further objects and advantages of the present invention will become further apparent from the following detailed description taken with respect to the annexed drawings.

BRIEF DESCRIPTION OF THE DRAWINGS

FIG. 1 is a schematic illustration of the bottom portions of a vertical blind with a pair of chains constructed according to the principles of the invention secured thereto;

FIG. 2 is a fragmentary illustration of a section of a chain constructed according to the principles of this invention;

FIG. 3 is a sectional view of the chain of FIG. 2, taken along the line 3—3;

FIG. 4 is a sectional view of the chain of FIG. 2, taken along the line 4—4; and FIG. 5 is a schematic illustration of the manner in which a chain can be constructed according to the principles of this invention.

DETAILED DESCRIPTION OF THE PREFERRED EMBODIMENT

FIG. 1 illustrates the lower portion of a vertical blind 10 with a chain 12 constructed according to the principles of the present invention. The vertical blind includes a series of vertically extending slats or louvers 14 which extend vertically and which normally extend at acute angles to each other. The lower portions of the slats(louvers) 14 include folded over portions 16 which are stitched to the main portions of the slats 14 and which enclose respective ballast weights 18 made of metal, cardboard or other rigid material. The folded over portions 16 and the ballast weights 18 provide ballast for the slates 14.

The chains 12 are constructed according to the principles of this invention. The chains 12 interconnect the lower portions of the slats 14. In the example of FIG. 1, there are two chains 12A and 12B illustrated. Each chain comprises a length of thread 20 with plurality of synthetic plastic balls 22 and synthetic plastic clips 24 secured to it. The clips 24 are each connected to the respective rigid ballast weights 18 secured to the slats 14. The plastic balls 22 extend between the clips 24 and help maintain the chains 12 in a preferred orientation between the clips.

As seen in FIG. 1, the chains 12A, 12B are each dimensioned such that the spacing between the clips 24 on the chains is equidistant. Thus, when the slats 14 are in the orientation of FIG. 1, the chains 12 help maintain the slats 14 in the relative orientation shown in FIG. 1 and also help to maintain the slats 14 in the vertical orientation shown. The vertical slats 14 are also slidably secured at their upper ends to a headrail (not shown), and there is normally little play when the vertical blind is in a desired orientation (e.g. the orientation of FIG. 1). However, when a vertical blind is intentionally manipulated (e.g., the slats 14 are rotated about vertical axes) the chains 12A, 12B help ensure that all of the vertical slats are rotated together and maintain consistent angular orientations relative to each other.

FIG. 2 illustrates a chain 12 constructed according to the principles of this invention. The chain 12 comprises a length of thread 20 preferrably formed of polyester, and preferrably having a braided configuration for maximum strength. A series of clamps 24 are secured to the thread 20 in a manner decribed more fully hereinafter. One clamp 24 is shown in FIG. 2. The clamp 24 comprises a plastic member having a pair of resilient fingers 26 for resiliently engaging a rigid ballast weight (e.g., 18) at the bottom of a slat 14. The clamp member 24 also has a seotion 28 seoured to the thread in a manner described more fully hereinafter.

A series of the balls 22 are also secured to the polyester thread 20 at spaced locations between each clip 24. The balls 22 are made of molded plastic, and help to ensure that the chain hangs at an appropriate angle, and also to provide a decorative appearance to the chain (see FIG. 1).

Both the balls 22 and the clips 24 are molded directly to the polyester thread 20. The balls 22 and the clips 24 are molded directly about the polyester thread so that they completely encircle(circumscribe) a respective portion of the polyester thread, as shown in FIGS. 3 and 4. The molding of the balls and the clips directly to the polyester thread provides a firm engagement of the balls 22 and the clips 24 to the polyester thread.

The molding of the balls and clips directly to the polyester thread also facilitates continuous manufacture of the chain of the invention, as illustrated schematically in FIG. 5. Specifically, the length of thread can be located in a mold cavity 30 that has a section 32 for molding a series of balls and a section 34 for molding a clip. The cavity allows a set of the plastic balls 22 and a clip 24 to be molded directly to the polyester thread length 20. The thread can then be drawn through the cavity and another set of balls 22 an clip 24 can be molded to the thread 20. This process is repeated until a desired number of balls and clips are molded to the thread.

Thus, the concept of the present invention provides a ready vehicle for continuous manufacture of a chain. Further, by using a braided polyester thread the chain is believed to have considerable strength, and the molding of plastic balls allows a decorative appearance to the chain to be readily provided.

With the foregoing disclosure in mind, it is believed that various obvious modifications of the concept of the present invention will become apparent to those of ordinary skill in the art.

What is claimed:

1. A chain for attachment to a vertical blind, comprising a longitudinally extending length of thread, a plurality of plastic clips fixedly secured to said length of thread at spaced intervals, each of said plastic clips having a means for engaging a portion of a vertical blind, each of said plastic clips having a portion completely circumscribing a respective portion of said thread, a plurality of plastic objects fixedly secured to said length of thread at a plurality of locations spaced between said clips, each of said plastic objects completely circumscribing its respective location on said thread, each of said plastic clips and said plastic objects being integrally molded to said length of thread.

2. A chain as set forth in claim 1 wherein said length of thread comprises a length of polyester thread.

3. A chain as set forth in claim 2 wherein said polyester thread has a braided configuration.

4. A chain as set forth in claim 3 wherein each of said plastic objects is spherical in shape.

5. A chain for attachment to a vertical blind, said chain consisting essentially of a longitudinally extending length of braided polyester thread having a plurality of plastic clips and plastic objects integrally molded directly thereto at spaced locations to fixedly connect said plastic clips and said plastic objects to said braided polyester thread at said spaced locations, each of said plastic clips and plastic objects being integrally molded to and completely circumscribing a respective portion of said length of braided polyester thread.

* * * * *